US011549771B2

(12) United States Patent
Lyle et al.

(10) Patent No.: US 11,549,771 B2
(45) Date of Patent: Jan. 10, 2023

(54) SPEED LOADER

(71) Applicants: Michael A. Lyle, Gainesville, GA (US); Crissandra Y. Lyle, Gainesville, GA (US)

(72) Inventors: Michael A. Lyle, Gainesville, GA (US); Crissandra Y. Lyle, Gainesville, GA (US)

( * ) Notice: Subject to any disclaimer, the term of this patent is extended or adjusted under 35 U.S.C. 154(b) by 0 days.

(21) Appl. No.: 17/396,252

(22) Filed: Aug. 6, 2021

(65) Prior Publication Data

US 2022/0057155 A1 Feb. 24, 2022

Related U.S. Application Data

(60) Provisional application No. 63/066,970, filed on Aug. 18, 2020, provisional application No. 63/076,653, filed on Sep. 10, 2020.

(51) Int. Cl.
*F41A 9/85* (2006.01)

(52) U.S. Cl.
CPC ..... *F41A 9/85* (2013.01)

(58) Field of Classification Search
CPC ..... F41A 9/83; F41A 9/85
USPC ..... 42/87, 89
See application file for complete search history.

(56) References Cited

U.S. PATENT DOCUMENTS

| | | | | |
|---|---|---|---|---|
| 1,971,526 | A * | 8/1934 | Kempf | F41A 9/85 42/89 |
| 3,667,146 | A * | 6/1972 | Dupouy | F41A 9/85 42/89 |
| 3,824,729 | A * | 7/1974 | Kubik | F41A 9/85 42/89 |
| 5,621,998 | A * | 4/1997 | Norgaard | F41A 9/85 42/89 |
| 10,563,942 | B2 | 2/2020 | Head | |
| 11,060,811 | B2 | 7/2021 | Litvinov | |
| 2018/0313621 | A1* | 11/2018 | Head | F42B 39/02 |

* cited by examiner

*Primary Examiner* — Bret Hayes
(74) *Attorney, Agent, or Firm* — Bennet K. Langlotz; Langlotz Patent & Trademark Works, LLC

(57) ABSTRACT

A speed loader has an elongated planar body with opposed major faces, the elongated planar body defining a plurality of cartridge receptacles on one of the opposed major faces, each of the plurality of cartridge receptacles configured to removably retain the head of a cartridge, the plurality of cartridge receptacles arranged along the length of the elongated planar body in an articulated sequence, at least some of the plurality of cartridge receptacles being arranged in at least two obtuse triangular subgroups, each of the obtuse triangular subgroups having three different cartridge receptacles, and each obtuse triangular subgroup having two end cartridge receptacles proximate one major edge of the elongated planar body and an intermediate cartridge receptacle proximate an opposed major edge of the elongated planar body. The obtuse triangular subgroups may face the same major edge or opposite major edges. The obtuse triangular subgroups may each define an arc.

14 Claims, 18 Drawing Sheets

SPEED LOADER

CROSS-REFERENCE TO RELATED APPLICATION

This application claims the benefit of U.S. Provisional Patent Application No. 63/066,970 filed on Aug. 18, 2020, entitled "Revolver Speed Loader," and also claims the benefit of U.S. Provisional Patent Application No. 63/076,653 filed on Sep. 10, 2020, entitled "Revolver Speed Loader," which are hereby incorporated by reference in their entirety for all that is taught and disclosed therein.

FIELD OF THE INVENTION

The present invention relates to firearms, and more particularly to a speed loader that enables a revolver to be reloaded more easily and quickly.

BACKGROUND AND SUMMARY OF THE INVENTION

One handicap of any revolver is the time required to reload each chamber of the revolver cylinder with ammunition. Revolver speed loaders, in some form, have been around since the 19th century. The speed loader holds and aligns ammunition cartridges so the cartridges can be loaded into the cylinder chambers easier and more quickly.

Conventional speed loaders fall into one of two groups. A flexible, inline strip-style speed loader (commonly called a speed strip) arranges the cartridges in a single linear row where either one or two cartridges can be loaded into the revolver at a time. The inline strip speed loader is made of a flexible material and can lay flat in a pocket or case, making it more comfortable and concealable for the user to carry. For the most common revolvers, the reloading process requires three engagements of the inline strip speed loader with the cylinder to fully reload the revolver. Existing inline strip speed loaders maintain the same spacing between sockets. This distance is established by the shortest center-to-center distance between any two adjacent chambers on a given revolver cylinder. The gap between cartridges loaded in the inline strip speed loader is equal to the shortest centerline distance between two adjacent chambers, minus the ammunition shell diameter. While the inline strip speed loader functions as intended, the user must carefully align the speed loader with the cylinder when reloading. Otherwise, insufficient clearance for the cylinder perimeter exists, which prevents reloading. An error in alignment requires the user to make an adjustment, which increases reloading time.

The other type of speed loader is a rigid, round-style speed loader. The round speed loader holds as many cartridges as the revolver cylinder has chambers, so all chambers of the revolver can be loaded at one time. The round speed loader is rigid and bulky, making it more difficult and uncomfortable to carry without a pouch or holster. However, the reloading process is 3-5 times faster than with an inline strip speed loader because all cartridges are loaded with a single engagement with the revolver. Although round speed loaders function as intended, round speed loaders have extended bodies that extend far to the rear of the case heads. In smaller revolvers such as Smith & Wesson J-frame and K-frame models, round speed loaders are not usable because the cylinder does not open far enough to let the round speed loader clear a protruding portion of the grip. Some people modify grips or select slim grips with other disadvantages to use existing round speed loaders.

Therefore, a need exists for a new and improved speed loader that holds and aligns ammunition cartridges so the cartridges can be loaded into the cylinder chambers easier and more quickly. In this regard, the various embodiments of the present invention substantially fulfill at least some of these needs. In this respect, the speed loader according to the present invention substantially departs from the conventional concepts and designs of the prior art, and in doing so provides an apparatus primarily developed for the purpose of holding and aligning ammunition cartridges so the cartridges can be loaded into the cylinder chambers easier and more quickly.

The present invention provides an improved speed loader, and overcomes the above-mentioned disadvantages and drawbacks of the prior art. As such, the general purpose of the present invention, which will be described subsequently in greater detail, is to provide an improved speed loader that has all the advantages of the prior art mentioned above.

To attain this, the preferred embodiment of the present invention essentially comprises an elongated planar body with opposed major faces, the elongated planar body defining a plurality of cartridge receptacles on one of the opposed major faces, each of the plurality of cartridge receptacles configured to removably retain the head of a cartridge, the plurality of cartridge receptacles arranged along the length of the elongated planar body in an articulated sequence, at least some of the plurality of cartridge receptacles being arranged in at least two obtuse triangular subgroups, each of the obtuse triangular subgroups having three different cartridge receptacles, and each obtuse triangular subgroup having two end cartridge receptacles proximate one major edge of the elongated planar body and an intermediate cartridge receptacle proximate an opposed major edge of the elongated planar body. The obtuse triangular subgroups may face the same major edge. The obtuse triangular subgroups may face opposite major edges. The obtuse triangular subgroups may each define an arc, the arcs having a common radius. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
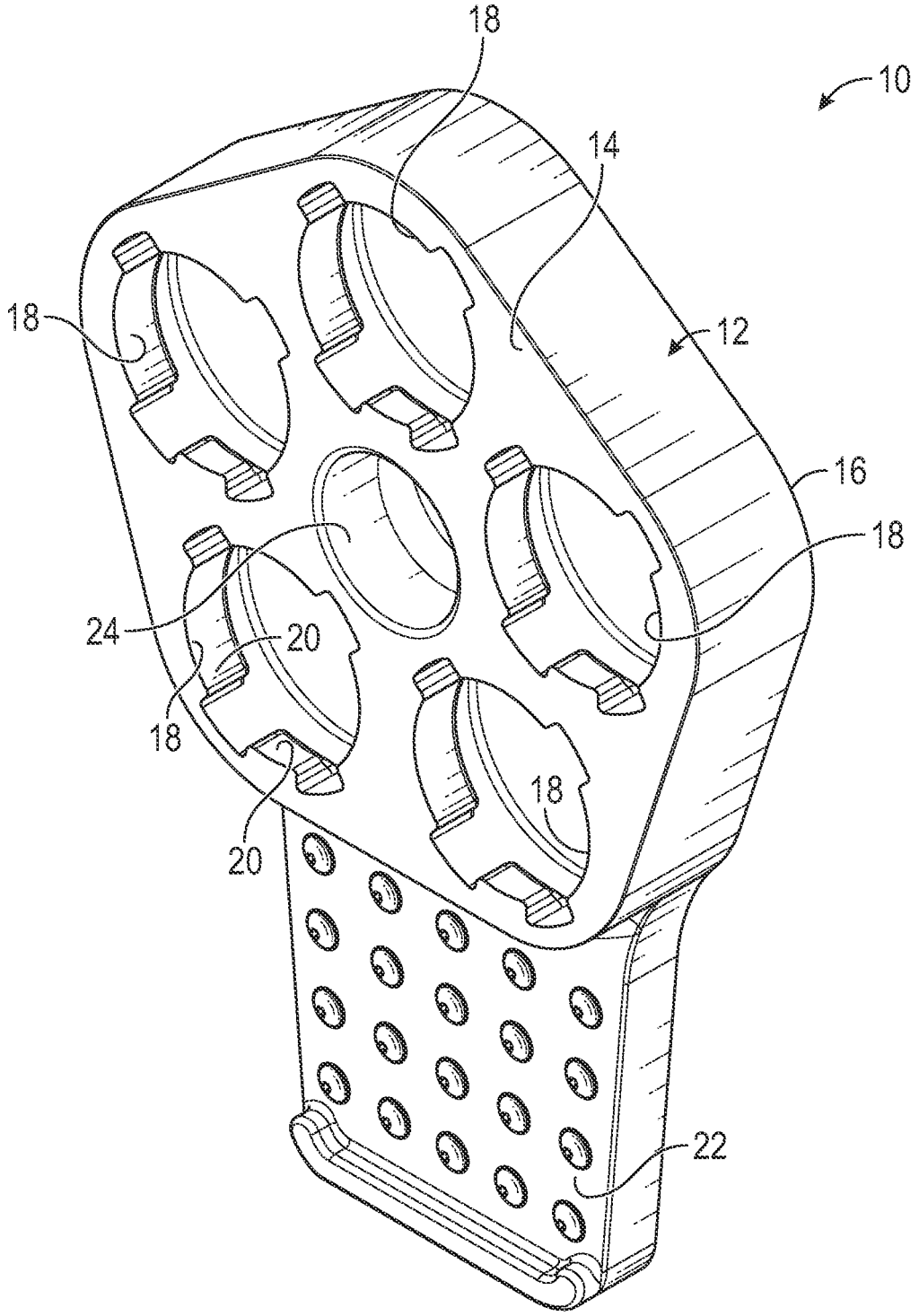
FIG. 1 is a top isometric view of the current embodiment of a speed loader constructed in accordance with the principles of the present invention for use with a Smith & Wesson J-frame revolver.

An embodiment of the speed loader of the present invention is shown and generally designated by the reference numeral 10.

Figure 17:
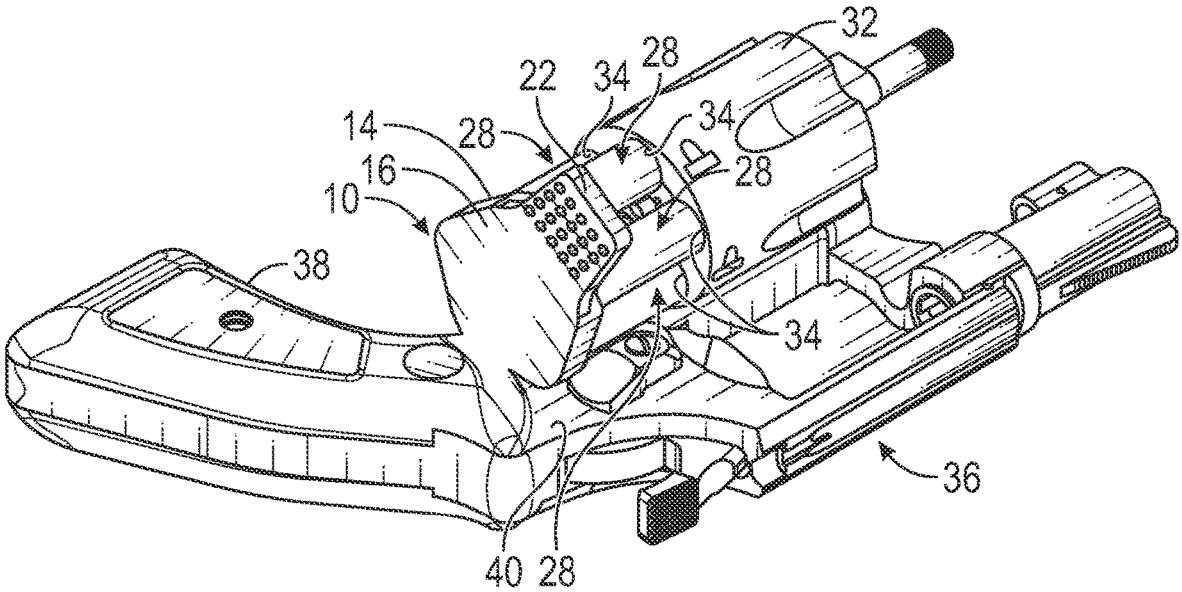
FIG. 17 is a bottom rear isometric view of the speed loader of FIG. 1 in use loading five cartridges into the cylinder of a Smith & Wesson J-frame revolver, with the entire revolver shown.
Figure 18:
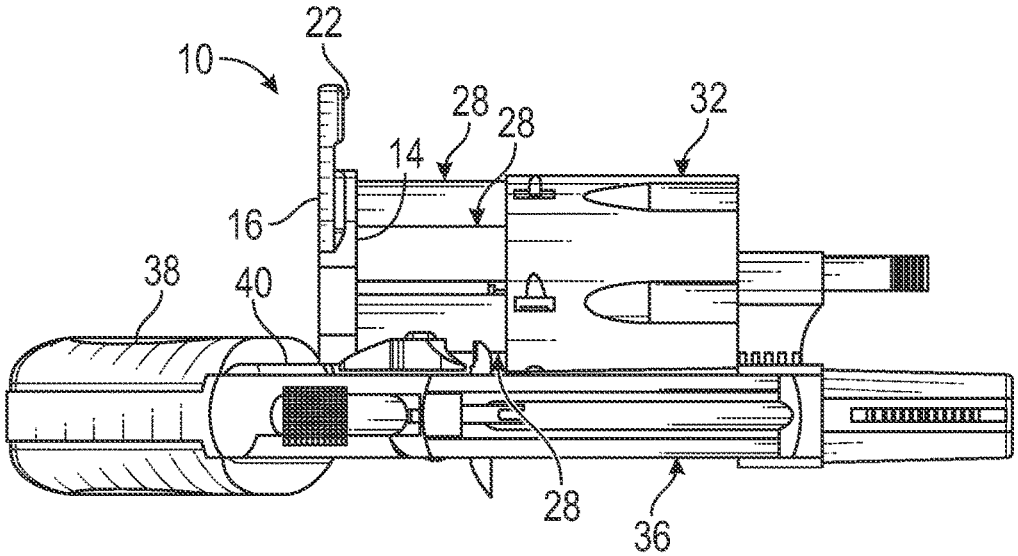
FIG. 18 is a side view of the speed loader of FIG. 1 in use loading five cartridges into the cylinder of a Smith & Wesson J-frame revolver, with the entire revolver shown.
Figure 19:
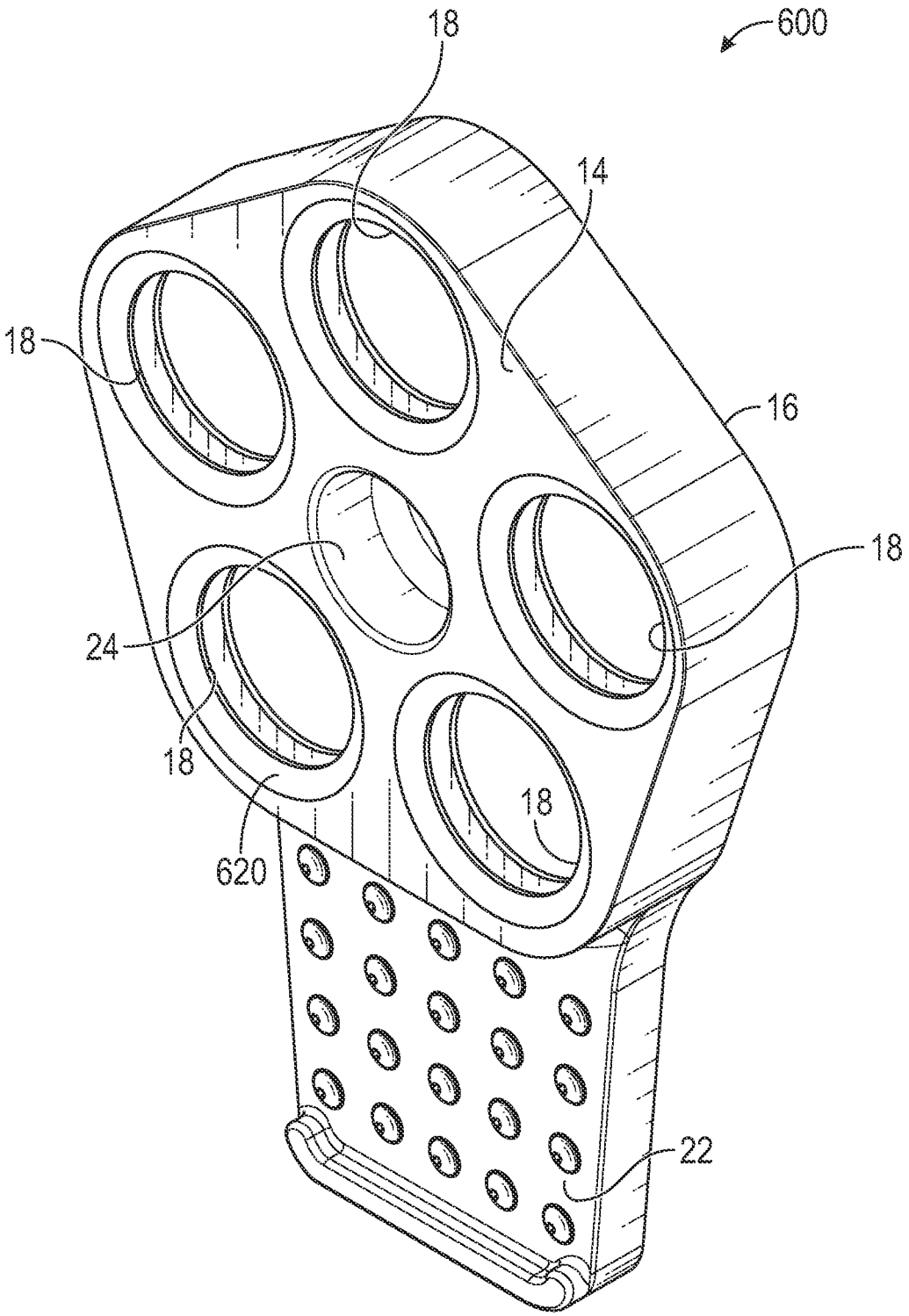
FIG. 19 is a top isometric view of a sixth alternative embodiment of a speed loader constructed in accordance with the principles of the present invention for use with a Smith & Wesson J-frame revolver.

FIGS. 1, 17 & 18 illustrate the improved speed loader 10 of the present invention. More particularly, the speed loader 10 has an elongated planar body 12 having opposed major faces 14, 16. The elongated planar body defines a plurality of cartridge receptacles 18 on one of the opposed major faces. Each of the plurality of cartridge receptacles is configured to removably retain the head of a cartridge, which is accomplished by each cartridge receptacle having multiple fixed jaws 20 that are arranged to prevent the cartridge flange from falling from a cartridge receptacle unintentionally. Although multiple fixed jaws are the preferred method of retaining cartridges, a sixth alternative embodiment of the speed loader 600 with continuous jaws 620, as shown in FIG. 19, is also suitable to removably retain the head of a cartridge. The speed loader 600 is otherwise identical to the speed loader 10. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. The elongated planar body includes a tab 22 that is used to pull the speed loader away from the cartridges once they are inserted into a revolver cylinder. The elongated planar body defines a central aperture 24 that receives the centrally located pin of the revolver extractor during the loading process. In the current embodiment, the elongated planar body forms a pentagon and defines five cartridge receptacles for use with a 5-shot revolver, such as a Smith & Wesson J-frame revolver. As is shown in FIGS. 17 & 18, use of a pentagon shape instead of a circular shape, in combination with a thin profile, provides adequate clearance for the revolver grip 38 and frame 40 while still enabling all revolver chambers to be loaded simultaneously. The thin elongated planar body allows the cartridges 28 to fully extract from the cartridge receptacles before the elongated planar body strikes the grip 38. This is unlike conventional speed loaders that extend much farther rearward of the cartridge heads to accommodate the retention and release mechanisms. The polygonal shape of the speed loader 10 provides further enhanced clearance. In the current embodiment, the elongated planar body is a unitary body formed of an elastomer.

Figure 2:
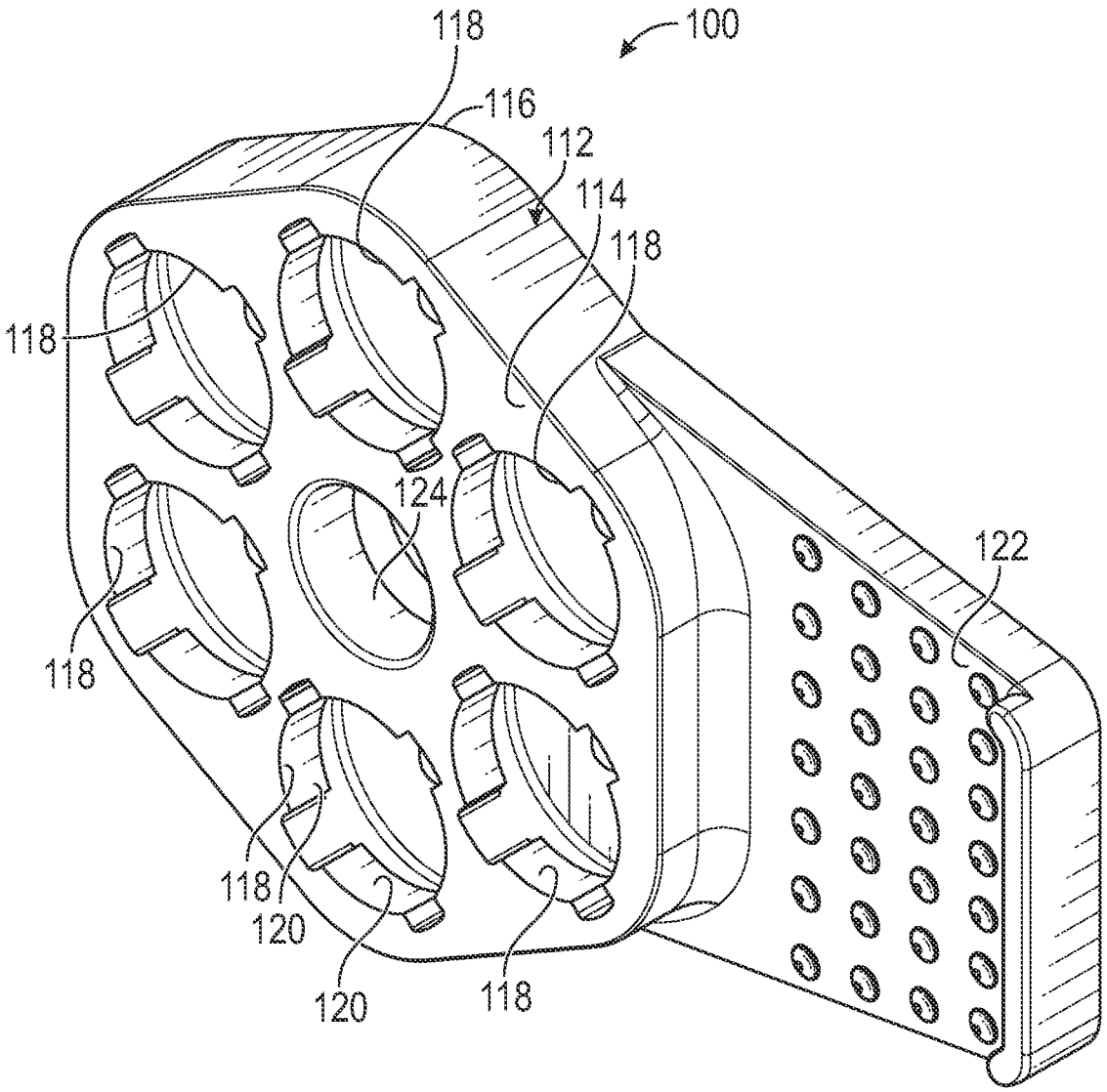
FIG. 2 is a top isometric view of a first alternative embodiment of a speed loader constructed in accordance with the principles of the present invention for use with a Smith & Wesson K-frame revolver.

FIG. 2 illustrates a first alternative embodiment of the improved speed loader 100 of the present invention. More particularly, the speed loader 100 has an elongated planar body 112 having opposed major faces 114, 116. The elongated planar body defines a plurality of cartridge receptacles 118 on one of the opposed major faces. Each of the plurality of cartridge receptacles is configured to removably retain the head of a cartridge, which is accomplished by each cartridge receptacle having multiple fixed jaws 120 that are arranged to prevent the cartridge flange from falling from a cartridge receptacle unintentionally. Continuous jaws 620 are also suitable for use with the speed loader 100. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. The elongated planar body includes a tab 122 that is used to pull the speed loader away from the cartridges once they are inserted into a revolver cylinder. The elongated planar body defines a central aperture 124 that receives the centrally located pin of the revolver extractor during the loading process. In the current embodiment, the elongated planar body forms a hexagon and defines six cartridge receptacles for use with a 6-shot revolver, such as a Smith & Wesson K-frame revolver. The use of a hexagon shape instead of a circular shape, in combination with a thin profile, provides adequate clearance for the revolver grip 38 and frame 40 while still enabling all revolver chambers to be loaded simultaneously.

In the current embodiment, the elongated planar body is a unitary body formed of an elastomer.

Figure 3:
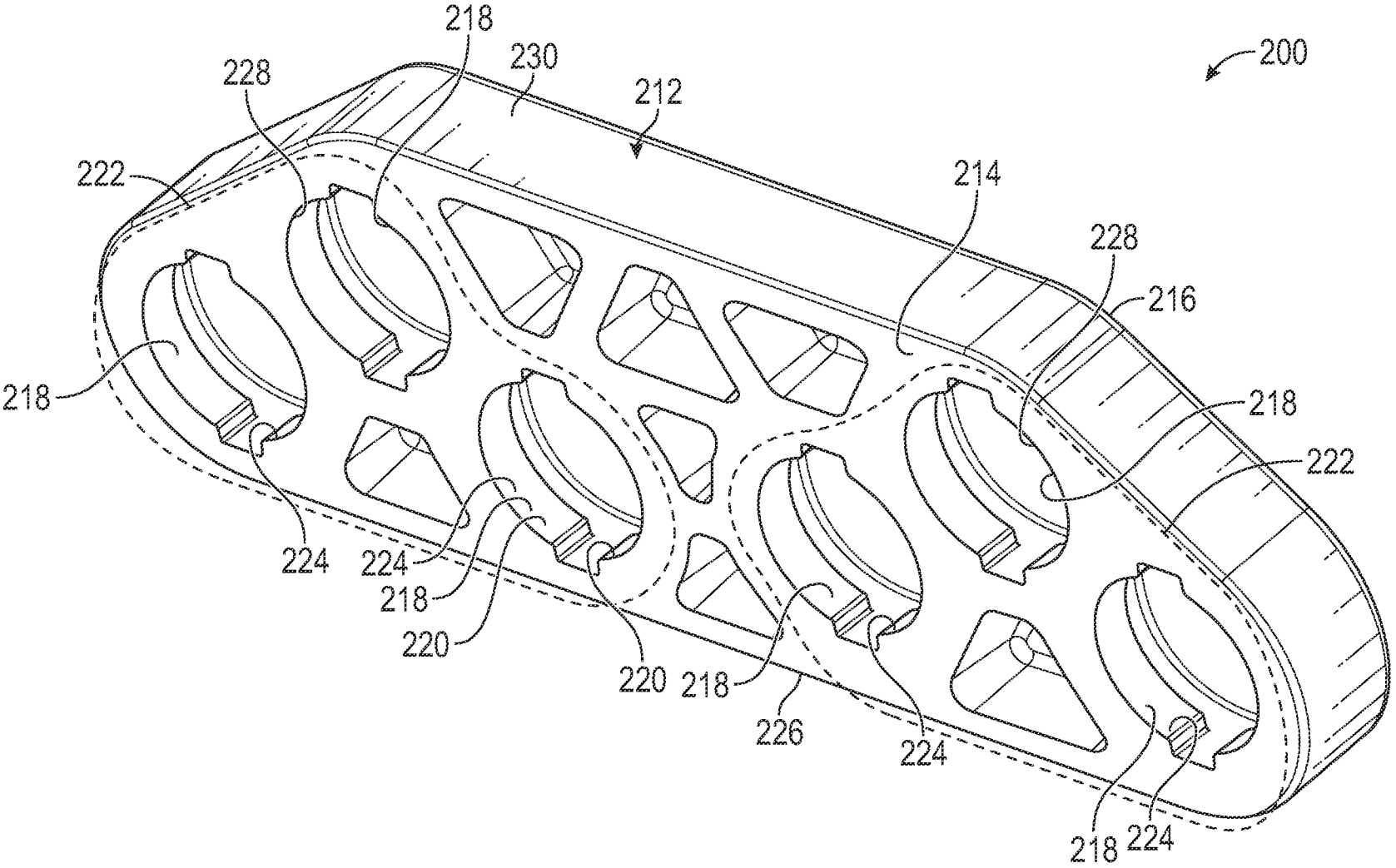
FIG. 3 is a top isometric view of a second alternative embodiment of a speed loader constructed in accordance with the principles of the present invention for use with a Smith & Wesson J-frame revolver.
Figure 4:
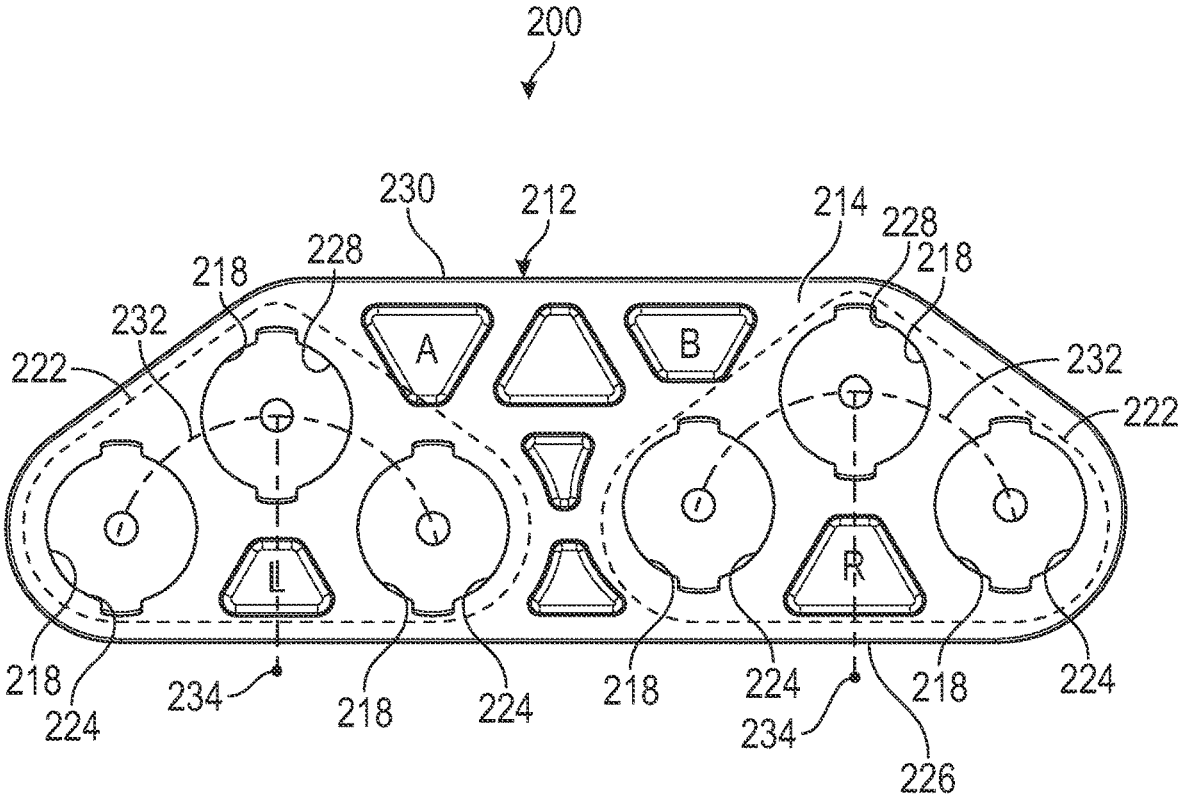
FIG. 4 is a front view of the speed loader of FIG. 3.

FIGS. 3 & 4 illustrate a second alternative embodiment of the improved speed loader 200 of the present invention. More particularly, the speed loader 200 has an elongated planar body 212 having opposed major faces 214, 216. The elongated planar body defines a plurality of cartridge receptacles 218 on one of the opposed major faces. Each of the plurality of cartridge receptacles is configured to removably retain the head of a cartridge, which is accomplished by each cartridge receptacle having multiple fixed jaws 220 that are arranged to prevent the cartridge flange from falling from a cartridge receptacle unintentionally. Continuous jaws 620 are also suitable for use with the speed loader 200. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. In the current embodiment, the elongated planar body is a unitary body formed of an elastomer.

In the current embodiment, the plurality of cartridge receptacles 218 are arranged along the length of the elongated planar body 212 in an articulated sequence. At least some of the plurality of cartridge receptacles being arranged in at least two obtuse triangular subgroups 222, each of the obtuse triangular subgroups having three different cartridge receptacles. Each obtuse triangular subgroup has two end cartridge receptacles 224 proximate one major edge 226 of the elongated planar body and an intermediate cartridge receptacle 228 proximate an opposed major edge 230 of the elongated planar body. The obtuse triangular subgroups face the same major edge in the current embodiment. The obtuse triangular subgroups each define an arc 232, the arcs having a common radius. The obtuse triangular subgroups each define an arc having a center of radius 234, the spacing of the plurality of cartridge receptacles in each obtuse triangular subgroup defining a regular angular spacing of the cartridge receptacles corresponding to a capacity of a selected revolver cylinder, the number of cartridge receptacles being greater than the capacity. In the current embodiment, the elongated planar body forms a trapezoid and defines six cartridge receptacles for use with a 5-shot revolver, such as a Smith & Wesson J-frame revolver. Thus, the number of cartridge receptacles is greater than the capacity by one. The angular spacing between the cartridge receptacles is 72 degrees. The use of a trapezoid shape instead of a rectangular shape provides adequate clearance for the revolver frame while still enabling up to three revolver chambers to be loaded simultaneously. The cartridge receptacles are in an offset arrangement with no more than two receptacles being aligned in a straight line. The cartridge receptacles are also in an offset arrangement with none of cartridge receptacles aligned on a straight line connecting any two other cartridge receptacles. However, alternative arrangements of cartridge receptacles are also possible, including the alignment of more than two receptacles in a straight line. The spacing of cartridge receptacles within an obtuse triangular subgroup is less than the spacing between any cartridge receptacle of one obtuse triangular subgroup and any cartridge receptacle of any other obtuse triangular subgroup. It should also be appreciated that adjacent obtuse triangular subgroups are not aligned with each other. The speed loader 200 is ambidextrous for use by both right and left-handed users.

Figure 5:
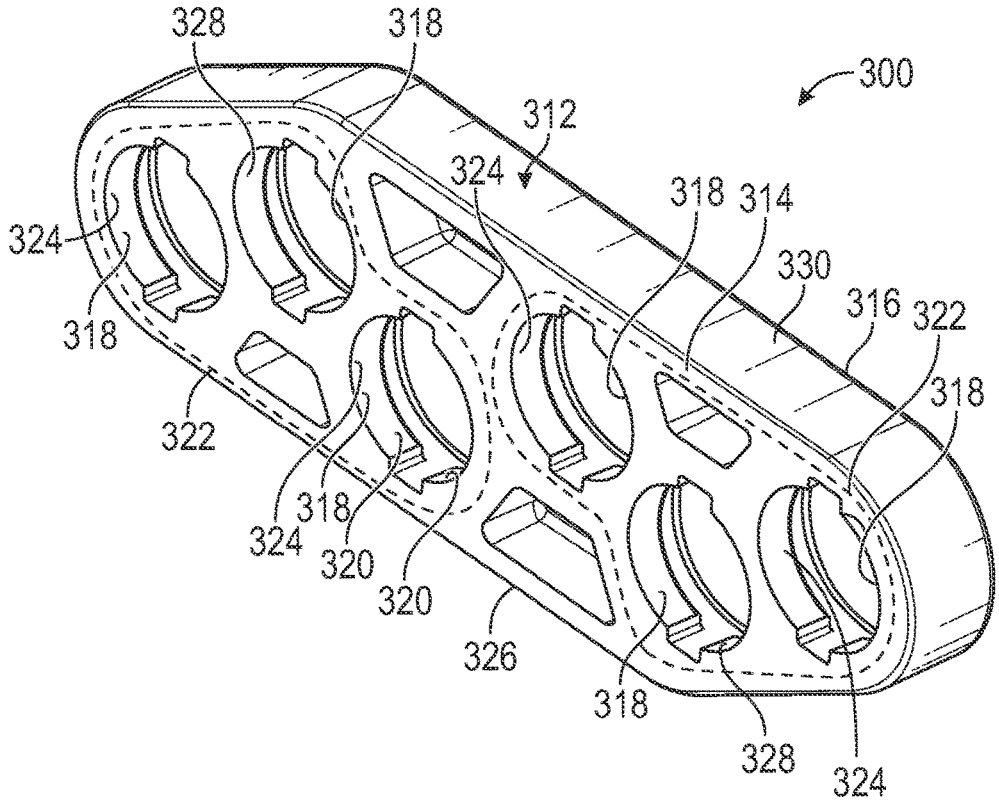
FIG. 5 is a top isometric view of a third alternative embodiment of a speed loader constructed in accordance with the principles of the present invention for use with a Smith & Wesson K-frame revolver.
Figure 6:
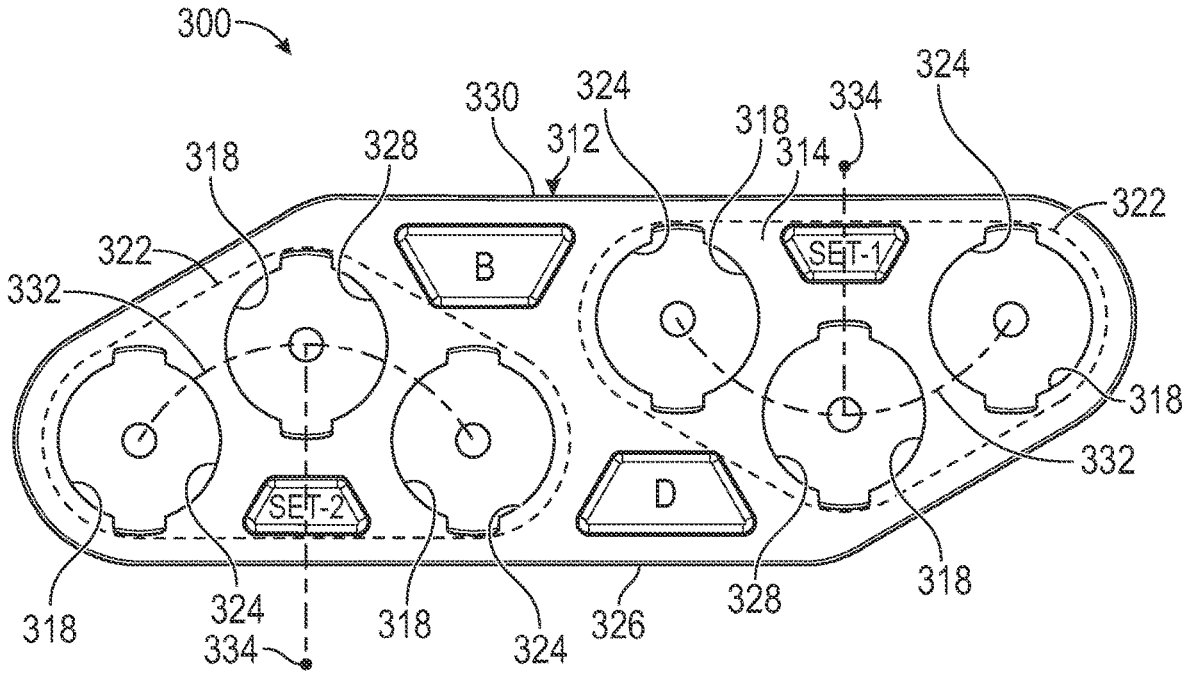
FIG. 6 is a front view of the speed loader of FIG. 5.
Figure 7:
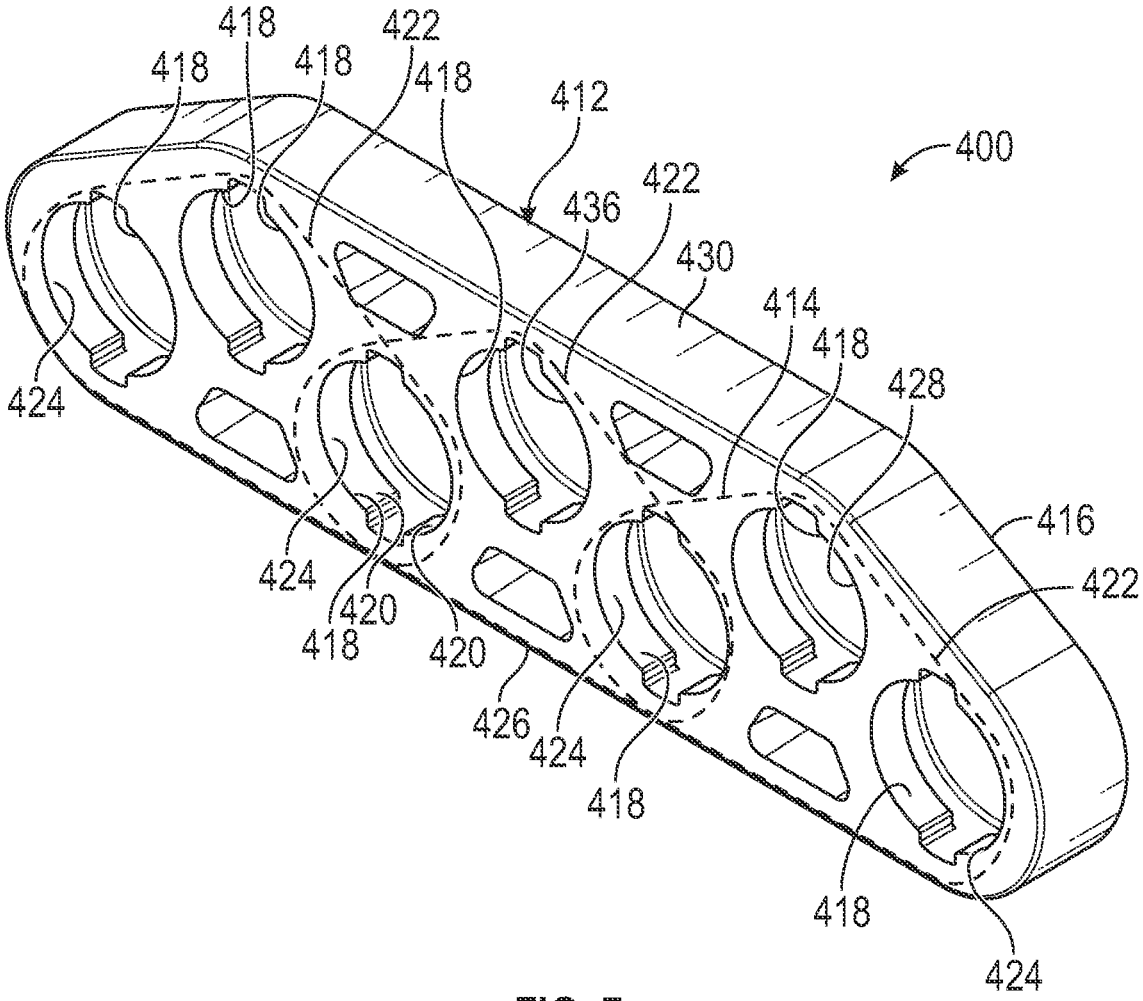
FIG. 7 a top isometric view of a fourth alternative embodiment of a speed loader constructed in accordance with the principles of the present invention for use with a Smith & Wesson K-frame revolver.
Figure 8:
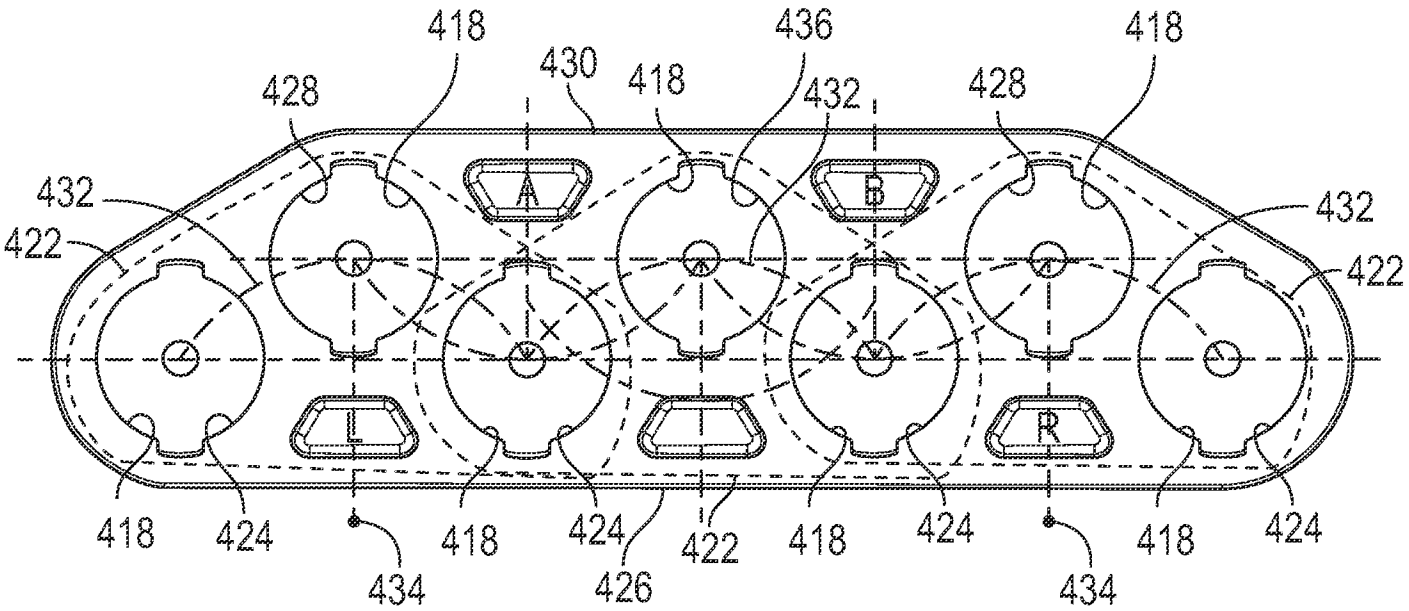
FIG. 8 is a front view of the speed loader of FIG. 7.

FIGS. 5 & 6 illustrate a third alternative embodiment of the improved speed loader 300 of the present invention. More particularly, the speed loader 300 has an elongated planar body 312 having opposed major faces 314, 316. The elongated planar body defines a plurality of cartridge receptacles 318 on one of the opposed major faces. Each of the plurality of cartridge receptacles is configured to removably retain the head of a cartridge, which is accomplished by each cartridge receptacle having multiple fixed jaws 320 that are arranged to prevent the cartridge flange from falling from a cartridge receptacle unintentionally. Continuous jaws 620 are also suitable for use with the speed loader 300. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. In the current embodiment, the elongated planar body is a unitary body formed of an elastomer.

In the current embodiment, the plurality of cartridge receptacles 318 are arranged along the length of the elongated planar body 312 in an articulated sequence. At least some of the plurality of cartridge receptacles being arranged in at least two obtuse triangular subgroups 322, each of the obtuse triangular subgroups having three different cartridge receptacles. Each obtuse triangular subgroup has two end cartridge receptacles 324 proximate one major edge 326 or 330 of the elongated planar body and an intermediate cartridge receptacle 328 proximate an opposed major edge 326 or 330 of the elongated planar body. The obtuse triangular subgroups face opposite major edges in the current embodiment. The obtuse triangular subgroups each define an arc 332, the arcs having a common radius. The obtuse triangular subgroups each define an arc having a center of radius 334, the spacing of the plurality of cartridge receptacles in each obtuse triangular subgroup defining a regular angular spacing of the cartridge receptacles corresponding to a capacity of a selected revolver cylinder, the number of cartridge receptacles being the same as the capacity. In the current embodiment, the elongated planar body forms a parallelogram and defines six cartridge receptacles for use with a 6-shot revolver, such as a Smith & Wesson K-frame revolver. The angular spacing between the cartridge receptacles is 60 degrees. The use of a parallelogram shape instead of a rectangular shape provides adequate clearance for the revolver frame while still enabling up to three revolver chambers to be loaded simultaneously. The cartridge receptacles are in an offset arrangement with no more than two receptacles being aligned in a straight line. The cartridge receptacles are also in an offset arrangement with none of cartridge receptacles aligned on a straight line connecting any two other cartridge receptacles. However, alternative arrangements of cartridge receptacles are also possible, including the alignment of more than two receptacles in a straight line. The spacing of cartridge receptacles within an obtuse triangular subgroup is less than the spacing between any cartridge receptacle of one obtuse triangular subgroup and any cartridge receptacle of any other obtuse triangular subgroup. It should also be appreciated that adjacent obtuse triangular subgroups are not aligned with each other. The speed loader 300 is ambidextrous and suitable for use by right and left-handed users.

Figure 9:
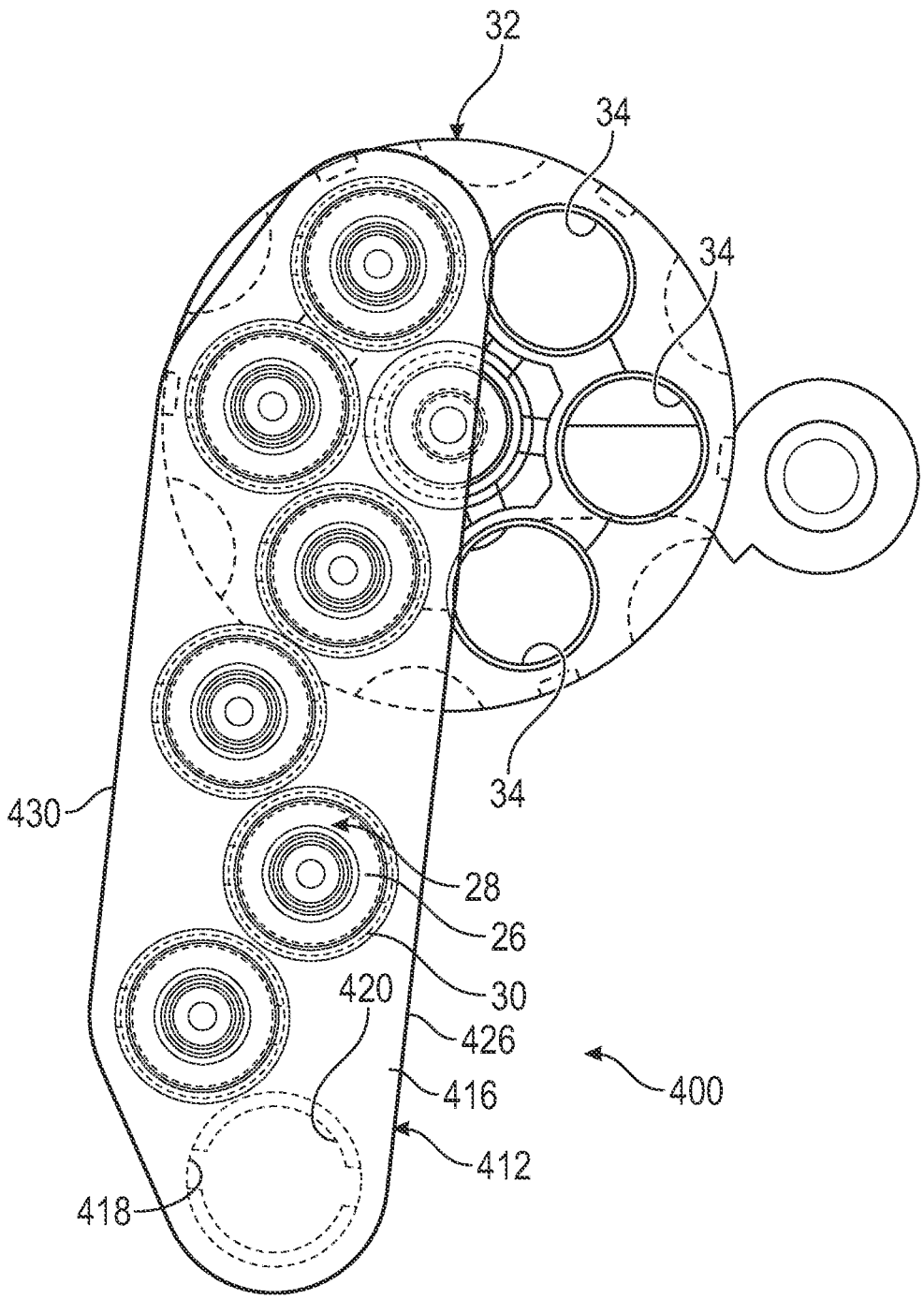
FIG. 9 is a rear view of the speed loader of FIG. 7 in use loading three cartridges into the cylinder of a Smith & Wesson K-frame revolver in the manner of a left-handed user.
Figure 10:
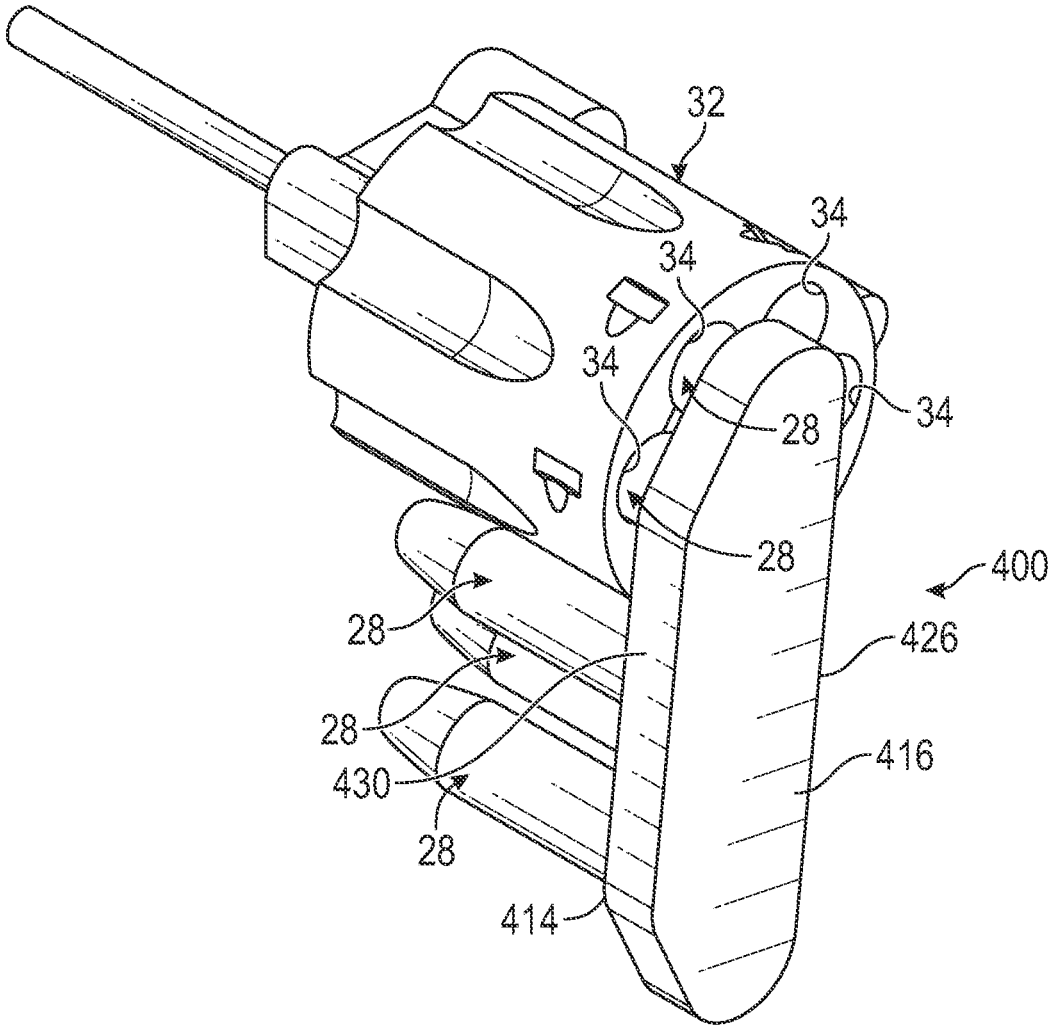
FIG. 10 is a top isometric view of the speed loader of FIG. 7 in use loading three cartridges into the cylinder of a Smith & Wesson K-frame revolver in the manner of a left-handed user.
Figure 11:
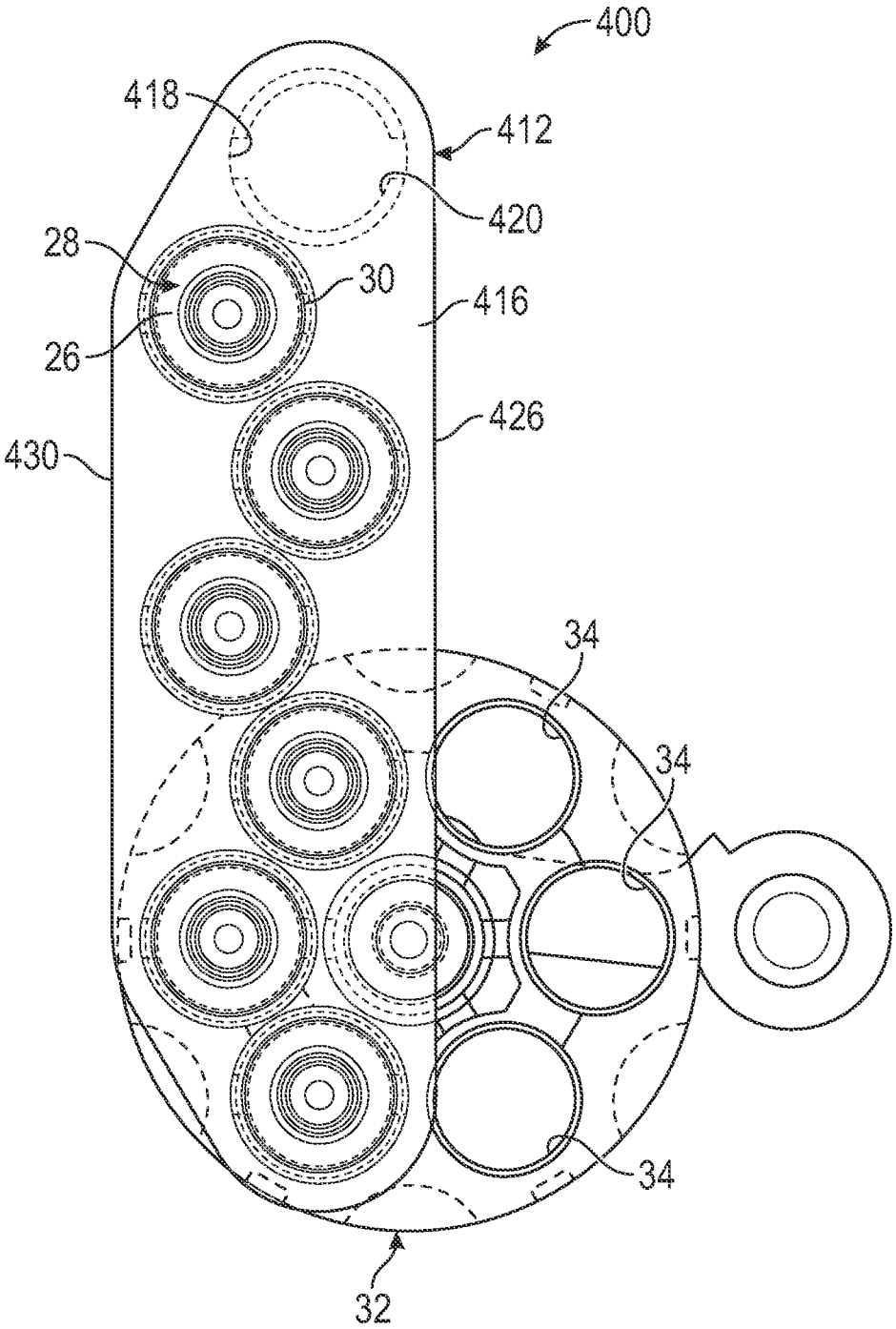
FIG. 11 is a rear view of the speed loader of FIG. 7 in use loading three cartridges into the cylinder of a Smith & Wesson K-frame revolver in the manner of a right-handed user.
Figure 12:
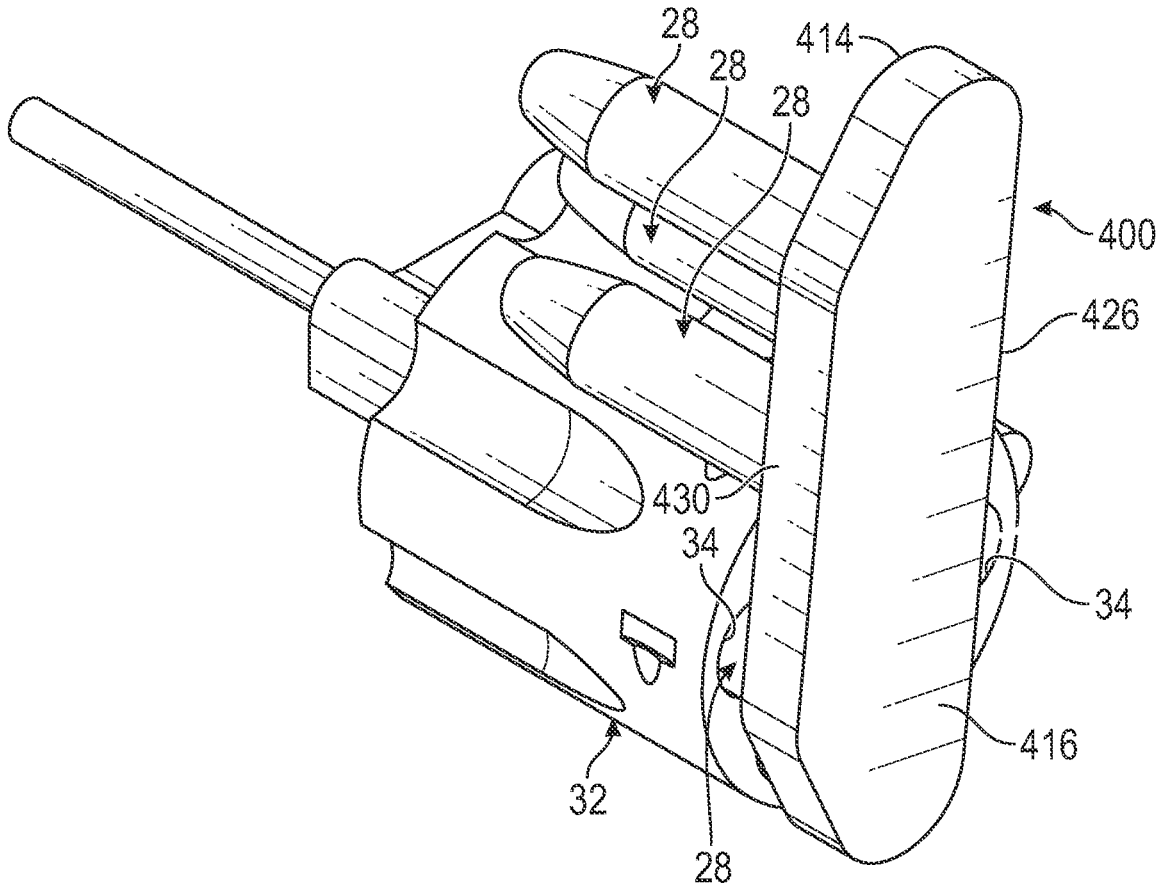
FIG. 12 is a top isometric view of the speed loader of FIG. 7 in use loading three cartridges into the cylinder of a Smith & Wesson K-frame revolver in the manner of a right-handed user.

FIGS. 7-12 illustrate a fourth alternative embodiment of the improved speed loader 400 of the present invention. More particularly, FIGS. 9 & 10 show the speed loader 400 in use by a left-handed user loading three cartridges 28 into three revolver chambers 34 of a revolver cylinder 32. FIGS. 11 & 12 show the speed loader 400 in use by a right-handed user loading three cartridges into three revolver chambers of a revolver cylinder. The speed loader 400 has an elongated planar body 412 having opposed major faces 414, 416. The elongated planar body defines a plurality of cartridge receptacles 418 on one of the opposed major faces. Each of the plurality of cartridge receptacles is configured to removably retain the head 26 of a cartridge, which is accomplished by each cartridge receptacle having multiple fixed jaws 420 that are arranged to prevent the cartridge flange 30 from falling from a cartridge receptacle unintentionally. Continuous jaws 620 are also suitable for use with the speed loader 400. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. In the current embodiment, the elongated planar body is a unitary body formed of an elastomer.

In the current embodiment, the plurality of cartridge receptacles 418 are arranged along the length of the elongated planar body 412 in an articulated sequence. At least some of the plurality of cartridge receptacles being arranged in at least two obtuse triangular subgroups 422, each of the obtuse triangular subgroups having three different cartridge receptacles. Each obtuse triangular subgroup has two end cartridge receptacles 424 proximate one major edge 426 of the elongated planar body and an intermediate cartridge receptacle 428 proximate an opposed major edge 430 of the elongated planar body. The obtuse triangular subgroups face the same major edge in the current embodiment. The obtuse triangular subgroups each define an arc 432, the arcs having a common radius. The obtuse triangular subgroups each define an arc having a center of radius 434, the spacing of the plurality of cartridge receptacles in each obtuse triangular subgroup defining a regular angular spacing of the cartridge receptacles corresponding to a capacity of a selected revolver cylinder 32, the number of cartridge receptacles being greater than the capacity. In the current embodiment, the elongated planar body forms a trapezoid and defines seven cartridge receptacles for use with a 6-shot revolver, such as a Smith & Wesson K-frame revolver. Thus, the number of cartridge receptacles is greater than the capacity by one. The angular spacing between the cartridge receptacles is 60 degrees. The use of a trapezoid shape instead of a rectangular shape provides adequate clearance for the revolver frame while still enabling up to three revolver chambers 34 to be loaded simultaneously. The cartridge receptacles are in a linear arrangement with at least three receptacles being aligned in a straight line. The two obtuse triangular subgroups are separated by an intermediate cartridge receptacle 436, which is aligned to create a third obtuse triangular subgroup by including the two adjacent cartridge receptacles. Adjacent obtuse triangular subgroups are aligned with each other. The speed loader 400 is ambidextrous and suitable for use by right and left-handed users.

Figure 13:
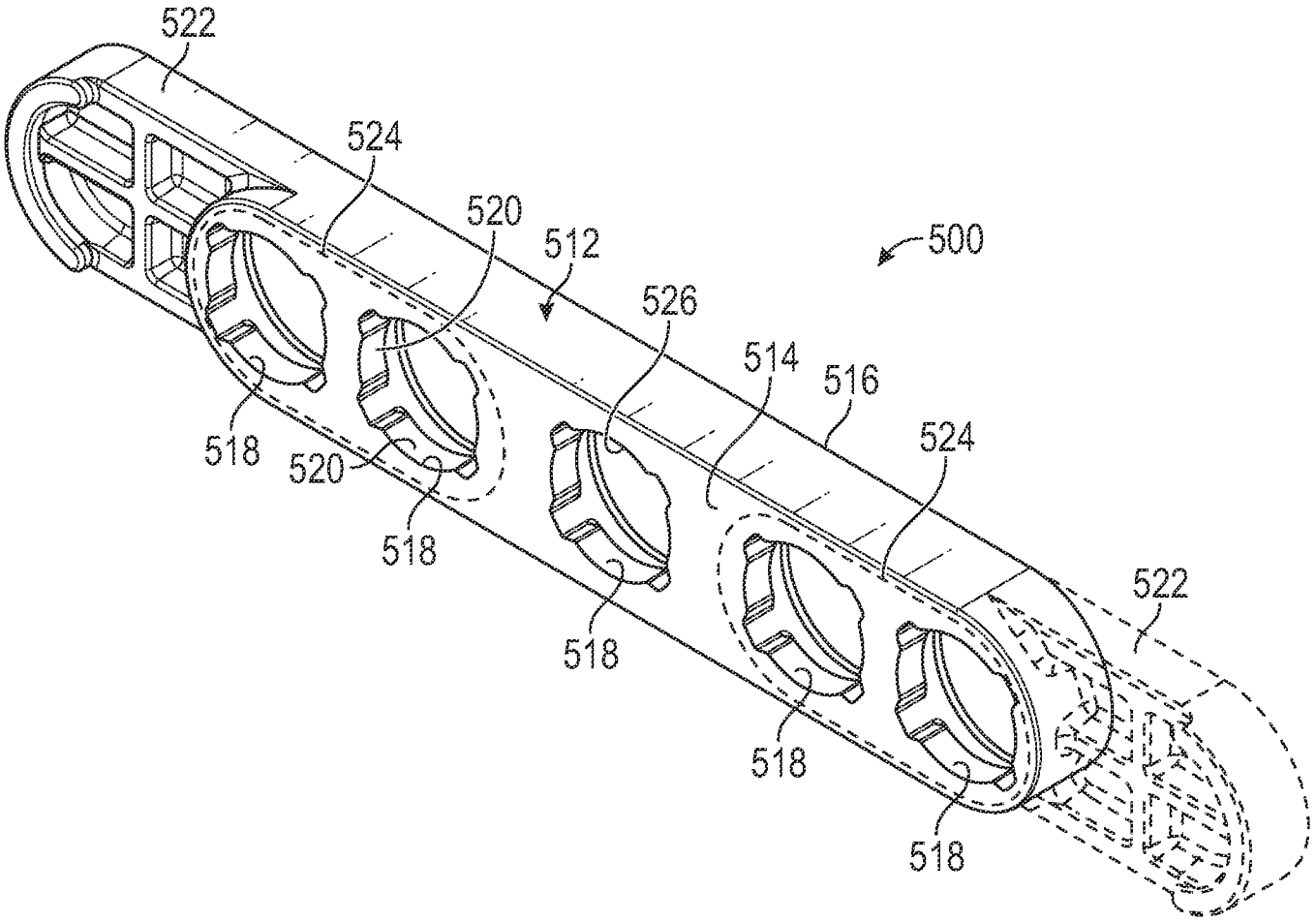
FIG. 13 is a top isometric view of a fifth alternative embodiment of a speed loader constructed in accordance with the principles of the present invention for use with a Smith & Wesson J-frame revolver.
Figure 14:
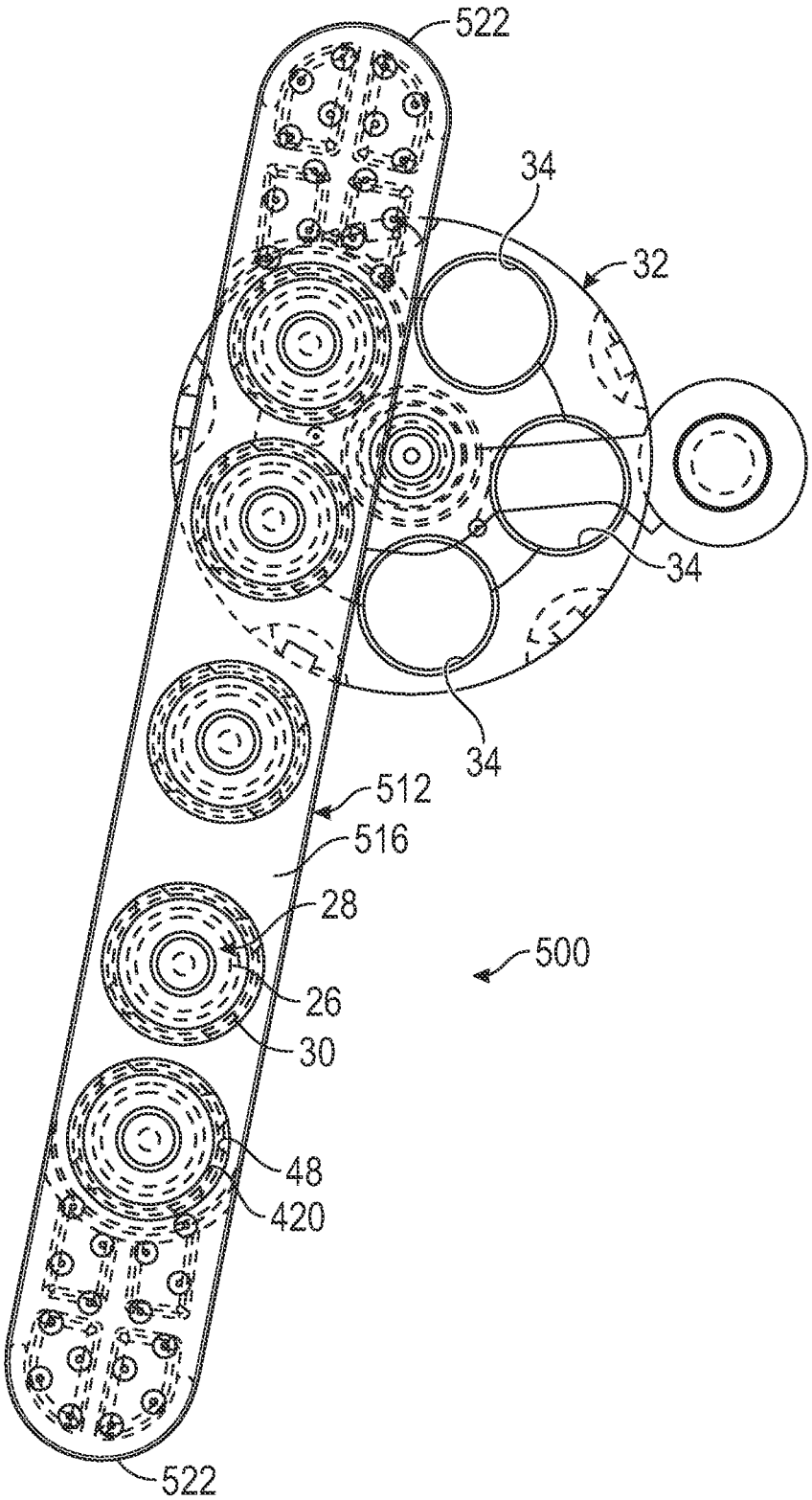
FIG. 14 is a rear view of the speed loader of FIG. 13 in use loading two cartridges into the cylinder of a Smith & Wesson J-frame revolve in the manner of a left-handed user.
Figure 15:
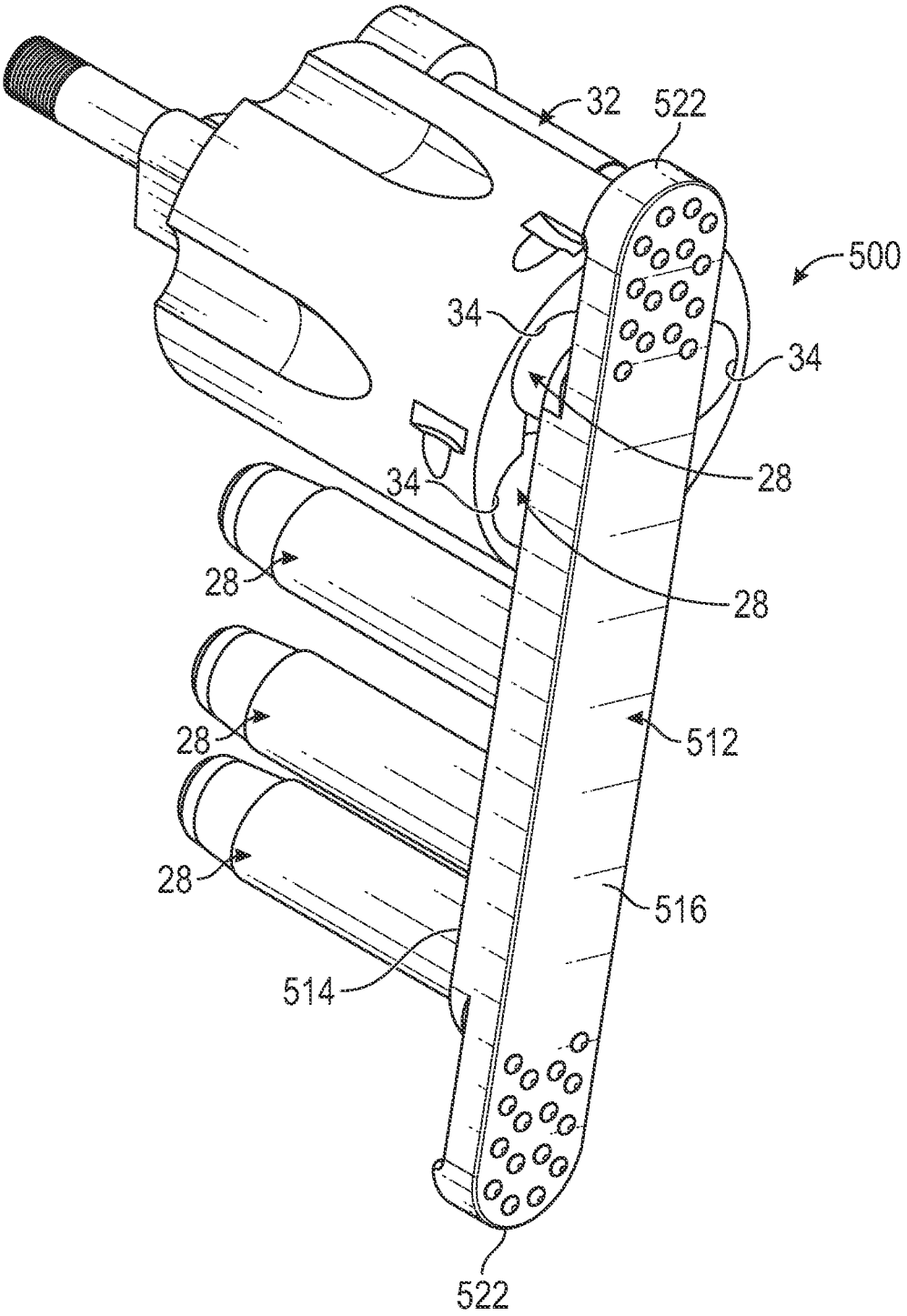
FIG. 15 is a top isometric view of the speed loader of FIG. 13 in use loading two cartridges into the cylinder of a Smith & Wesson J-frame revolver in the manner of a left-handed user.
Figure 16:
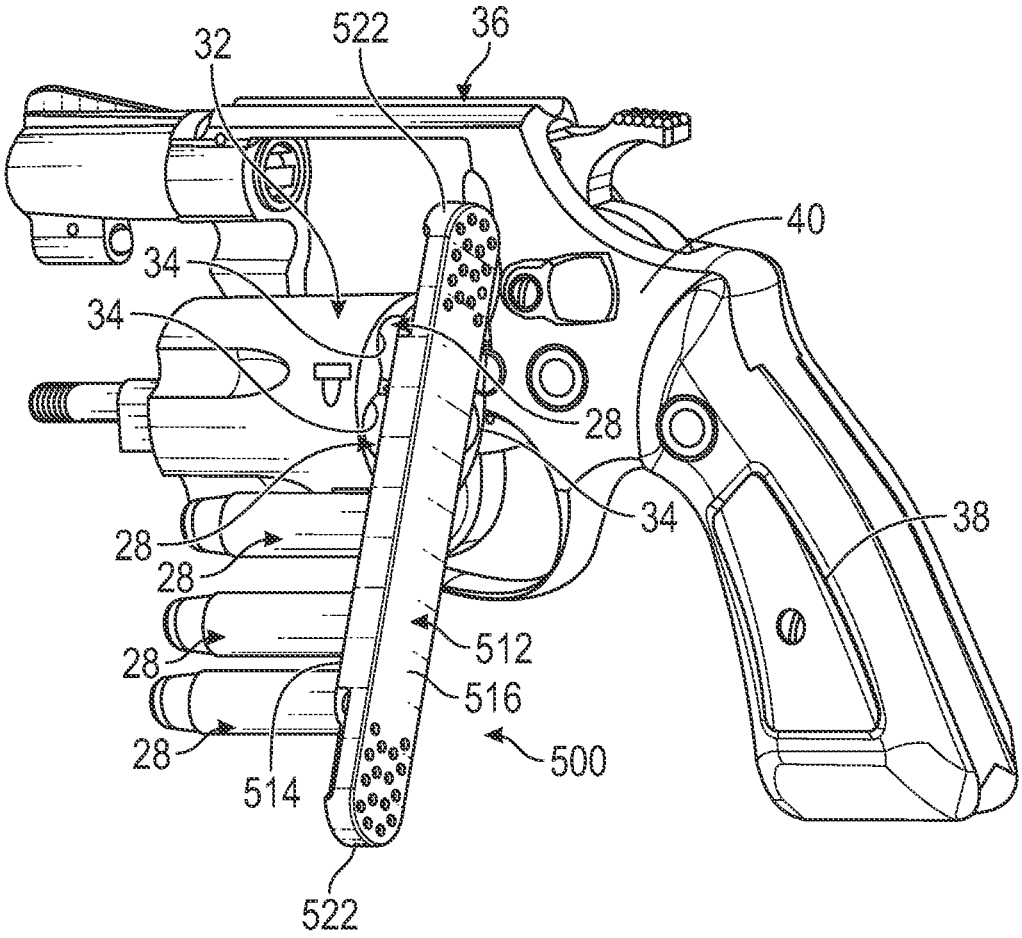
FIG. 16 is a top isometric view of the speed loader of FIG. 13 in use loading two cartridges into the cylinder of a Smith & Wesson J-frame revolver in the manner of a left-handed user, with the entire revolver shown.

FIGS. 13-15 illustrate a fifth alternative embodiment of the improved speed loader 500 of the present invention. More particularly, FIGS. 14 & 15 show the speed loader 500 in use by a left-handed user loading two cartridges 28 into two revolver chambers 34 of a revolver cylinder 32, with FIG. 15 showing a complete revolver 36. The speed loader 500 has an elongated planar body 512 having opposed major faces 514, 516. The elongated planar body defines a plurality of cartridge receptacles 518 on one of the opposed major faces. Each of the plurality of cartridge receptacles is configured to removably retain the head 26 of a cartridge, which is accomplished by each cartridge receptacle having multiple fixed jaws 520 that are arranged to prevent the cartridge flange 30 from falling from a cartridge receptacle unintentionally. Continuous jaws 620 are also suitable for use with the speed loader 500. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. In the current embodiment, the elongated planar body is a unitary body formed of an elastomer. The elongated planar body includes tabs 522 at either end that are used to pull the speed loader away from the cartridges once they are inserted into a revolver cylinder. It should be appreciated the speed loader 500 can be manufactured with only a single tab, or no tabs, to meet user preferences for carrying compactness. The speed loader 500 is preferentially manufactured symmetrically with user-removable tabs on both ends.

In the current embodiment, the plurality of cartridge receptacles 518 are arranged along the length of the elongated planar body 512 in a linear sequence. At least some of the plurality of cartridge receptacles are arranged in at least two subgroups 524, each of the subgroups having two different cartridge receptacles. The two subgroups are separated by an intermediate cartridge receptacle 526. The spacing of the two different cartridge receptacles in each subgroup corresponds to the spacing between two revolver chambers 34 of a selected revolver cylinder 32, with a greater spacing between each of the two subgroups and the intermediate cartridge receptacle. The greater spacing provides adequate clearance for the revolver cylinder while still enabling up to two revolver chambers to be loaded simultaneously. The number of cartridge receptacles is equal to the capacity of the revolver cylinder. In the current embodiment, the elongated planar body defines 5 cartridge receptacles for use with a 5-shot revolver, such as a Smith & Wesson J-frame revolver. The cartridge receptacles are in a linear arrangement with all of the cartridge receptacles being aligned in a straight line. The speed loader 500 is ambidextrous and suitable for use by right and left-handed users.

Figure 20:
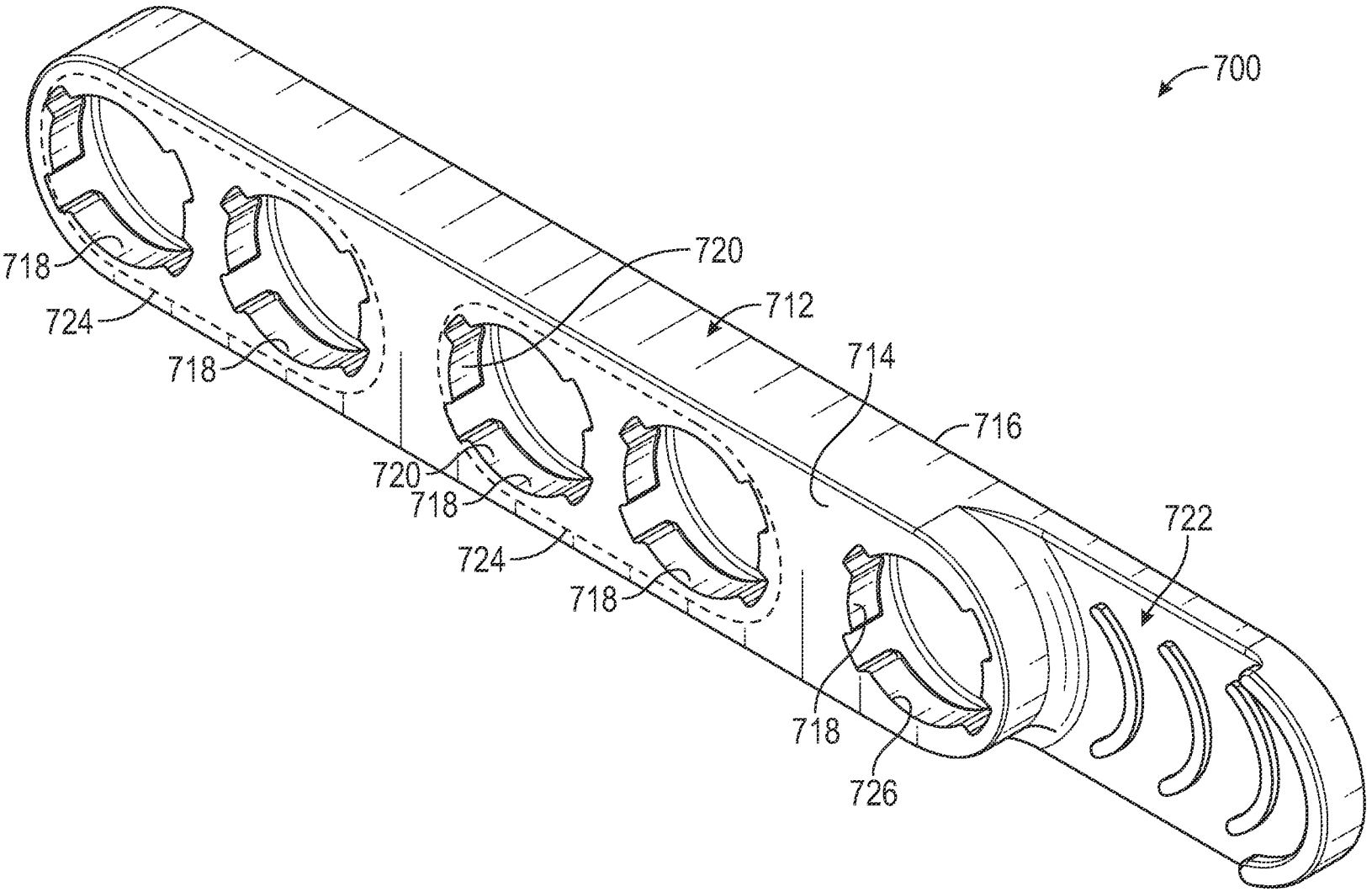
FIG. 20 is a top isometric view of a seventh alternative embodiment of a speed loader constructed in accordance with the principles of the present invention for use with a Smith & Wesson J-frame revolver.

FIG. 20 illustrates a seventh alternative embodiment of the improved speed loader 500 of the present invention. More particularly, the speed loader 700 has an elongated planar body 712 having opposed major faces 714, 716. The elongated planar body defines a plurality of cartridge receptacles 718 on one of the opposed major faces. Each of the plurality of cartridge receptacles is configured to removably retain the head 26 of a cartridge, which is accomplished by each cartridge receptacle having multiple fixed jaws 720 that are arranged to prevent the cartridge flange 30 from falling from a cartridge receptacle unintentionally. Continuous jaws 620 are also suitable for use with the speed loader 700. The cartridge flange is located underneath and held by the jaws. The jaws are molded from a flexible material so the jaws can deform to release the cartridge flange, enabling the head of the cartridge to be removed from a cartridge receptacle. The elongated planar body can be molded from either a single material or from multiple materials. In the current embodiment, the elongated planar body is a unitary body formed of an elastomer. The elongated planar body includes a tab 722 at one end that is used to both orient and pull the speed loader away from the cartridges once they are inserted into a revolver cylinder.

In the current embodiment, the plurality of cartridge receptacles 518 are arranged along the length of the elongated planar body 512 in a linear sequence. At least some of the plurality of cartridge receptacles are arranged in at least two subgroups 524, each of the subgroups having two different cartridge receptacles. The two subgroups are adjacent to one another, with an additional cartridge receptacle 526 adjacent to the tab 722. The spacing of the two different cartridge receptacles in each subgroup corresponds to the spacing between two revolver chambers 34 of a selected revolver cylinder 32, with a greater spacing between each of the two subgroups and the additional cartridge receptacle. The greater spacing provides adequate clearance for the revolver cylinder while still enabling up to two revolver chambers to be loaded simultaneously. The number of cartridge receptacles is equal to the capacity of the revolver cylinder. In the current embodiment, the elongated planar body defines 5 cartridge receptacles for use with a 5-shot revolver, such as a Smith & Wesson J-frame revolver. The cartridge receptacles are in a linear arrangement with all of the cartridge receptacles being aligned in a straight line. The speed loader 700 is ambidextrous and suitable for use by right and left-handed users. The speed loader first loads rounds one and two (the ones farthest from the tab), then rounds three and four, and then round five (the one adjacent to the tab).

While a current embodiment of a speed loader has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A speed loader for storing and loading cartridges to a revolver cylinder comprising:

an elongated planar body with opposed major faces;

the elongated planar body having a length and defining a plurality of cartridge receptacles on one of the opposed major faces;

each of the plurality of cartridge receptacles configured to removably retain the head of a cartridge;

the plurality of cartridge receptacles arranged along the length of the elongated planar body in an articulated sequence;

at least some of the plurality of cartridge receptacles being arranged in at least two obtuse triangular subgroups, each of the obtuse triangular subgroups having three different cartridge receptacles;

each obtuse triangular subgroup having two end cartridge receptacles more proximate to one major edge of the elongated planar body than to an opposed major edge, and an intermediate cartridge receptacle more proximate to the opposed major edge of the elongated planar body than to the one major edge; and wherein the obtuse triangular subgroups each define an arc having a center of radius, a spacing of the plurality of cartridge receptacles in each obtuse triangular subgroup defining a regular angular spacing of the cartridge receptacles corresponding to a capacity of a selected revolver cylinder, a number of cartridge receptacles being greater than the capacity.

2. The speed loader of claim 1 wherein the obtuse triangular subgroups face the one major edge or the opposed major edge.

3. The speed loader of claim 1 wherein two of the at least two obtuse triangular subgroups face opposites of the major edges.

4. The speed loader of claim 1 wherein the obtuse triangular subgroups each define an arc, the arcs having a common radius.

5. The speed loader of claim 1 wherein the number of cartridge receptacles is greater than the capacity by one.

6. The speed loader of claim 1 wherein angular spacing between the cartridge receptacles is 72 degrees, and the number of cartridge receptacles is six.

7. The speed loader of claim 1 wherein angular spacing between the cartridge receptacles is 60 degrees, and the number of cartridge receptacles is seven.

8. The speed loader of claim 1 wherein the cartridge receptacles are in an offset arrangement with no more than two receptacles being aligned in a straight line.

9. The speed loader of claim 1 wherein the elongated planar body is a unitary body.

10. The speed loader of claim 1 wherein the elongated planar body is formed of an elastomer.

11. A speed loader for storing and loading cartridges to a revolver cylinder having a selected number of chambers arranged in a circular array and evenly spaced at a selected angle and at a selected spacing between adjacent chambers, the loader comprising:

a body defining a plurality of cartridge receptacles;

each of the plurality of cartridge receptacles configured to removably retain the head of a cartridge;

at least some of the plurality of cartridge receptacles being arranged in an obtuse triangular subgroup;

each of the obtuse triangular subgroups having three different cartridge receptacles arranged with the selected spacing and selected angle of the revolver cylinder;

the number of cartridge receptacles being greater than the selected number of chambers of the revolver cylinder.

12. The speed loader of claim 11 wherein the number of cartridge receptacles is greater than the capacity by one.

13. The speed loader of claim 11 wherein angular spacing between the cartridge receptacles is 72 degrees, and the number of cartridge receptacles is six.

14. The speed loader of claim 11 wherein angular spacing between the cartridge receptacles is 60 degrees, and the number of cartridge receptacles is seven.

* * * * *